US005839581A

United States Patent [19]

Vagedes

[11] Patent Number: 5,839,581

[45] Date of Patent: Nov. 24, 1998

[54] SPILL-RESISTANT DRINKING VESSEL WITH INDICIA

[76] Inventor: Douglas Vagedes, 3677 Hathaway Rd., Union, Ky. 41091

[21] Appl. No.: 911,163

[22] Filed: Aug. 14, 1997

[51] Int. Cl.[6] ..... B65D 47/06

[52] U.S. Cl. ..... 206/459.1; 215/230

[58] Field of Search ..... 116/309, 311–320; 206/217, 459.1, 534; 215/230; 40/310, 311

[56] References Cited

U.S. PATENT DOCUMENTS

| | | | |
|---|---|---|---|
| D. 165,778 | 1/1952 | Osen | D36/8 |
| D. 259,231 | 5/1981 | Kozlow, Sr. | D7/40 |
| D. 327,393 | 6/1992 | Green et al. | D7/511 |
| D. 359,417 | 6/1995 | Chen | D7/510 |
| D. 359,882 | 7/1995 | Birge, Jr. | D7/510 |
| D. 364,314 | 11/1995 | Humphrey et al. | D7/510 |
| D. 364,316 | 11/1995 | Humphrey et al. | D7/510 |
| D. 367,402 | 2/1996 | Bates et al. | D7/520 |
| D. 368,624 | 4/1996 | Forrer | D7/392.1 |
| 2,201,524 | 5/1940 | Esty | 40/2 |
| 2,550,568 | 4/1951 | Kersh | 128/252 |
| 2,700,837 | 2/1955 | Wyner | 40/70 |
| 2,739,564 | 3/1956 | North | 40/311 |
| 3,392,468 | 7/1968 | Wof | 40/307 |
| 3,974,916 | 8/1976 | Bartolucci | 206/459 |
| 4,207,982 | 6/1980 | Maxwell et al. | 206/459.1 |
| 4,243,156 | 1/1981 | Lobbestael | 222/541 |
| 4,288,006 | 9/1981 | Clover, Jr. | 206/534 |
| 4,548,157 | 10/1985 | Hevoyan | 206/534 |
| 4,621,670 | 11/1986 | Yuen | 206/459.1 |
| 4,756,440 | 7/1988 | Gartner | 220/90.4 |
| 4,759,139 | 7/1988 | Ricks | 40/310 |
| 4,877,119 | 10/1989 | Hosking | 206/459 |
| 4,961,510 | 10/1990 | Dvoracek | 220/90.4 |
| 5,301,802 | 4/1994 | Nemeroff | 206/217 |
| 5,363,983 | 11/1994 | Proshan | 220/717 |
| 5,366,109 | 11/1994 | Proshan | 220/717 |
| 5,492,077 | 2/1996 | Rose | 116/307 |

*Primary Examiner*—Jim Foster
*Attorney, Agent, or Firm*—Wood, Herron & Evans, LLP

[57] ABSTRACT

A child's cup includes a cup with a lid. The lid can be positioned on the cup to form a tight seal, but can be rotated about the rim of the cup. Indicia is formed, molded or placed on the peripheral edge of the lid and there is a mark on the cup. The lid can then be rotated to align one of the indicia with the mark to identify the use of a cup. In an alternate embodiment, the indicia would be printed or molded around the edge of the cup and the indicator would be located on the lid itself.

6 Claims, 1 Drawing Sheet

SPILL-RESISTANT DRINKING VESSEL WITH INDICIA

BACKGROUND OF THE INVENTION

When young children first learn to drink from cups, they have an initial problem with spilling the cup's contents. A first step in this learning process is for a child to learn to handle the vessel without concerning themselves with spilling. Therefore, cups with sipper or spouted lids are used to facilitate this early learning process.

The sipper lids also serve to save care-givers considerable time during the day which would have been devoted to cleaning up spilled drinks, but for the presence of a lid. Not only is furniture and other valuables around the child spared from possible damage resulting from spillage, but a sipper lid also saves a child's clothing from staining.

Such drinking vessels for children are disclosed in the prior art. But before this invention, children's drinking vessels had no device to indicate which child used a particular vessel.

Until now, the manufacture of child's drinking vessels with sipper lid has not provided a cup and lid with indicia to identify the cup's initial user. The absence of identifying marks has led to confusion when care-givers would attempt to keep one child from using another child's cup.

This confusion leads to mixing drinking vessels between various children which may result in the spread of bacteria, viruses and other contaminants. In a household with more than one child, or a day-care center with numerous children, unintentionally mixing drinking vessels among children creates a likelihood that contaminants would be spread between children, resulting in an outbreak of common infectious diseases if the care-giver did not keep track of and prevent children from drinking from other children's cups.

A further problem with the prior art is that unmarked drinking vessels can become a contentious issue between children who cannot keep track of their own cups. Unidentifiable cups act as a catalyst for disagreements between children over which vessel belongs to which child.

SUMMARY OF THE INVENTION

The present invention overcomes the above mentioned disadvantages of prior art drinking vessels by providing a drinking vessel which allows the care-giver, responsible for caring for more than one child, to easily associate a single vessel with a single child and, therefore, substantially reduce the likelihood of passing common childhood contaminants between multiple children in the same environment.

It has been a further objective of the invention to provide a drinking vessel which substantially reduces the likelihood of children becoming confused as to which vessel belongs to which child and, thereby, reducing the likelihood of bickering over the vessels.

These objectives of the invention are attained by marking a drinking vessel with indicia and an indicator. When the care-giver pairs a single indicia with the indicator, the care-giver may easily determine which drinking vessel belongs to which child. Where the indicia is the alphabet, it will encourage the children themselves to learn which letter identifies their cup.

More specifically, in preferred form, the invention calls for a drinking vessel with a cup having a lid. A plurality of indicia are marked around either an annular surface of the lid or the cup. An indicator is then marked on the other of cup or lid so that it may be aligned with a single chosen indicia. The lid may be made from a translucent or transparent material so that the indicator is visible even when it is marked on the cup when the lid's overhanging lip is fitted to the cup so that it overlies the indicator.

The objectives and features of the invention will become more readily apparent from the following description taken in conjunction with the accompanying drawings.

DETAILED DESCRIPTION OF THE INVENTION

Figure 1:
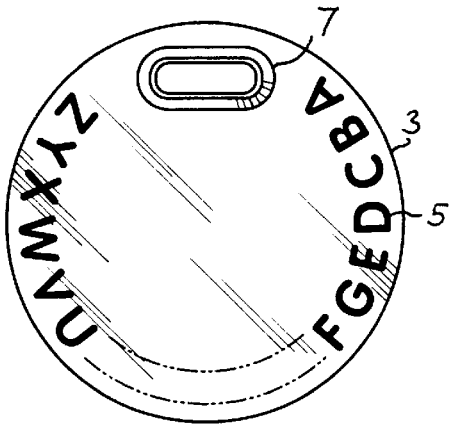
FIG. 1 is a top view of a preferred embodiment of a lid for a cup.
Figure 2:
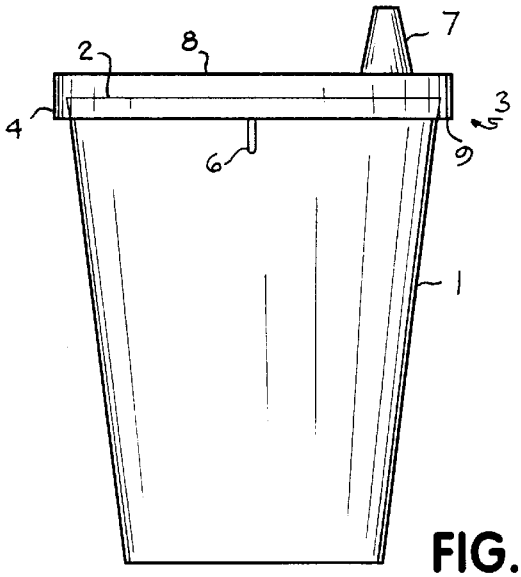
FIG. 2 shows indicia being carried on a first embodiment of a cup for use with the cap shown in FIG. 1.

As shown in FIGS. 1 and 2, a child's drinking vessel includes a cup 1 having a lid 3. The lid includes an overhanging lip 4 which fits over the top edge 2 of cup 1. The overhanging lip 4 is adapted to fit over the top edge 2 of cup 1 to seal the cup 1. The upper portion of cup 1 further includes an indicator 6. A drinking spout 7 extends upwardly from lid 3.

The top surface 8 of lid 3 further includes a plurality of indicia 5. Specifically, these indicia are raised letters, although other indicia such as numbers or a plurality of different embossed animals, geometric shapes or even colors may also be used. As shown in FIG. 1, the lid 3 is fitted over the top edge of the cup 2 onto the cup 1 so that one indicia of the different indicia 5 carried on the lid 3 can be aligned with indicator 6 carried on the cup 1.

In the embodiment shown in FIG. 1, the indicator 6 is marked on the cup 1 at a position in which the indicia 5 chosen may be easily referenced by the indicator 6. The indicia 5, in this embodiment, are marked by raised letters, or print or otherwise, in an annular pattern on the top surface of the lid 3.

Figure 3:
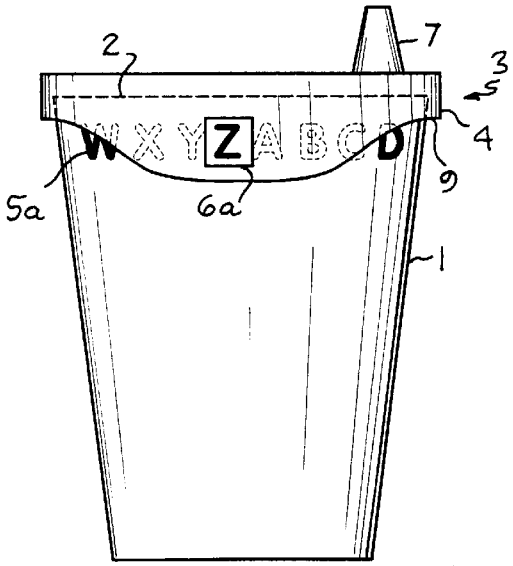
FIG. 3 shows a second embodiment of the invention.

As shown in FIG. 3, the indicia 5*a* is carried on the cup 1 and the overhanging lip 4 of the lid 3 defines an indicator 6*a*, through which a singular indicia 5*a* may be viewed.

Figure 4:
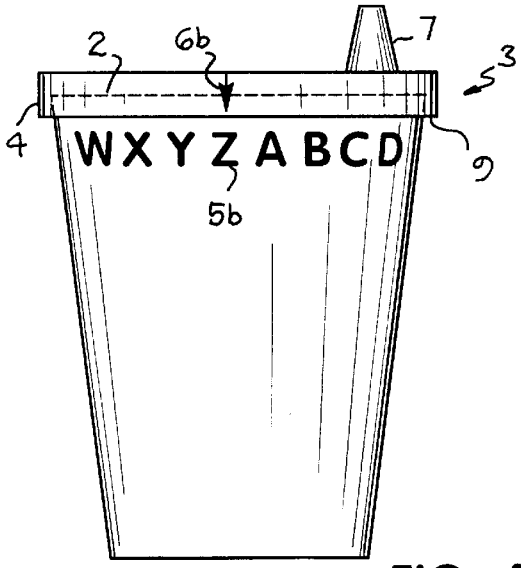
FIG. 4 shows a third embodiment of the invention.

As shown in FIG. 4, the indicia 5*b* is carried on cup 1 below the bottom edge 9 of lip 4. The indicator 6*b* is carried on the overhanging lip 4. This again is aligned with one indicia of indicia 5*b* to allow the care-giver or drinker to identify their drinking vessel.

Figure 5:
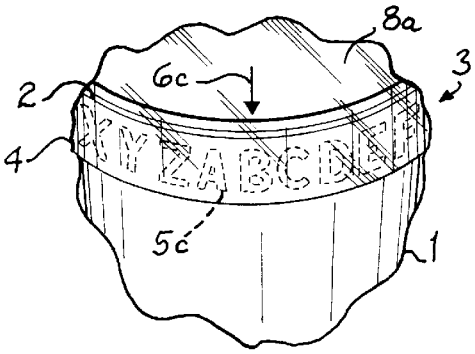
FIG. 5 is a broken away perspective view of a fourth embodiment of the invention having a transparent lid with an indicator on the lid's top surface being rotatably carried on the cup and indicia being carried proximate to the cup's top edge.

As shown in FIG. 5, the lid 3 is transparent so that indicia 5*c* formed on the cup may be seen through the overhanging lip 4 of lid 3. The indicator 6*c* is positioned on the top surface 8*a* of lid 3.

The child's drinking vessel as described provides a vessel with the above recited advantages. The drinking vessel allows the caregiver, responsible for caring for more than one child, to easily associate a single vessel with a single child and, therefore, substantially reduce the likelihood of passing common childhood contaminants between multiple children in the same environment. Furthermore, the indicia and indicator substantially reduces the likelihood of children becoming confused as to which vessel belongs to which child and, thereby, reducing the likelihood of bickering over the vessels. When the indicia is the alphabet, it also helps teach the alphabet to the children and the first letter in their name.

The preceding has been a description of the present invention along with preferred methods of practicing the present invention. However, the invention itself should only be defined by the appended claims wherein

We claim:

1. A child's drinking vessel, comprising:

a cup with a top edge;

a lid rotatably carried on said cup, said lid having a periphery and an overhanging lip extended from said periphery;

a drinking spout rising from the surface of said lid;

a plurality of indicia being carried by one of said cup and said lid around the periphery of either said cup or said lid; and an indicator identifying a specific indicia when said lid is rotated to align said indicator with said indicia whereby a drinker can identify their cup and distinguish it from cups of other drinkers;

wherein said indicator is carried on said cup; and said plurality of indicia are carried on said lid around its periphery.

2. The drinking vessel of claim 1, wherein:

said lid is transparent.

3. The drinking vessel of claim 1, wherein:

said plurality of indicia are on the periphery of said lid.

4. The drinking vessel of claim 1, wherein:

said plurality of indicia are on said overhanging lip.

5. A child's drinking vessel, comprising:

a cup with a top edge;

a lid rotatably carried on said cup, said lip having an overhanging lip;

a drinking spout rising from the surface of said lid;

the alphabet carried by said lid around the periphery of said lid's top surface; and an indicator carried on said cup at a distance from said cup's top edge so as not to be obscured by said lid when said lid is fitted to said cup.

6. A child's drinking vessel comprising:

a cup with a top edge;

a lid rotably carried on said cup, said lid having a periphery and an overhanging lip extended from said periphery;

a drinking spout rising from the surface of said lid;

a plurality of indicia being carried around the periphery of said cup;

an indicator on said overhanging lip of said lid indicator identifying a specific indicia when said lid is rotated to allign said indicator with said indicia whereby a drinker can identify their cup and distinguish it from the cups of other drinkers said indicator comprising a window through said overhanging lip of said lid.

* * * * *